United States Patent [19]

Bonet

[11] 4,391,460

[45] Jul. 5, 1983

[54] ADJUSTABLE MULTIPLE BOLT LOCKING SYSTEM

[76] Inventor: Jose D. Bonet, Martin el Humano, 12-6° València, Spain

[21] Appl. No.: 153,691

[22] Filed: May 27, 1980

[30] Foreign Application Priority Data

May 25, 1980 [ES] Spain ..... 480.950

[51] Int. Cl.[3] ..... E05C 1/06

[52] U.S. Cl. ..... 292/37; 292/39

[58] Field of Search ..... 292/37, 39; 312/218, 312/219

[56] References Cited

U.S. PATENT DOCUMENTS 1,600,982 9/1926 Golloway et al. ..... 292/39 X 1,996,865 4/1935 Haag ..... 292/39

2,672,745 3/1954 Marchetti ..... 292/39 X

FOREIGN PATENT DOCUMENTS 168099 8/1959 Sweden ..... 292/39

*Primary Examiner*—Roy D. Frazier

*Assistant Examiner*—Peter A. Aschenbrenner

*Attorney, Agent, or Firm*—Eyre, Mann, Lucas & Just

[57] ABSTRACT

The invention relates to an improvement in a multiple bolt locking device. In accordance with the invention, the entire locking assembly is contained inside a housing comprising a box section which extends over the entire length of the door. The locking mechanism is totally adjustable both in vertical dimension and in the positioning of horizontal bars providing extra security.

4 Claims, 29 Drawing Figures

ADJUSTABLE MULTIPLE BOLT LOCKING SYSTEM

The present descriptive memory has for main purpose that of the declaration of the object upon which will be granted the privilege of industrial and commercial use, exclusive for the national territory of a Letters Patent according with the present Law in force on Industrial Property, that, as per stated in the declaration refers to the "IMPROVEMENTS INTRODUCED IN THE SAFETY CLOSING SYSTEM".

It is well known the application in doors of safety systems upon the base that the door has multiple bolts actuated by a simple key and that in the frame exists a bolt-staple to receive such bolts, now then, all systems known up to this date have the difficulty of its installation and that they cannot be adapted to all solutions.

These difficulties have their origin in two circumstances that are fulfilled in the doors, one of them is that all doors have not the same dimensions, neither vertical nor horizontal, and the other because in the ribs appearing in the drawing of the door have been followed criteria of fanciful aesthetic and ornament, therefore it is difficult to obtain the continuity of a plain surface (without ribs) in the most suitable places for the installation of a closing system. All of this makes that all systems known to us are to be vertically applied to the whole dimension of the door apply to constructions based on profiled materials (several profiles in vertical direction) that must be sawed, spliced and coupled to give the required dimension to the door subject of this statement, with which it is performed a highly artistic work in the installation of each closing system and consequently it complicates considerably the installation work and finishing depends more on its quality than on the high or low skill of the labourer who has executed the installation; the existence of ribs usually implies relief, inlaid, sawing and similar operations for the coupling of systems known up to now. Those systems from the already mentioned concepts incorporating bolts horizontally arranged (as a strongback) even have a more complicated installation, as rarely the trimming ribs of door surface concur and so leaving free zones wherein we wish to install the strongback, consequently there is again the problem that besides the longitudinal adaptation of these sections there must be performed assarts, saws, to the door surface, which complicate the installation and put in danger the final aesthetic appearance of the system installed.

Each manufacturer of these systems is obliged to supply several pieces of different lengths, with which in providing a system of those known presently, it must be done a specific forwarding for order with the related packaging problems, diversity of stock pieces, etc. and always fearing that due to the forgetfulness or loss of some of these pieces the system cannot be fully istalled.

We believe to have resolved all the problems with the object of our invention, which refers to some improvements introduced in the safety closing systems that cover from a point of view completely new in regard to those we know, the conception of these systems.

According to the invention all the set of devices, transmissions, etc. composing the system will be housed inside a main holder constituted by one section profile of closed perimeter which originates the creation of a unique and authentic lock covering the total of door length dimensions without the existence of loose pieces;

it has been resolved that this holder can be easily adapted to any length of door and that it has its own means which allow besides the joined actuations of holder bolts, one or several horizontal strongbacks which are provided with its bar and latch, can be there coupled, if so required, and located at any height of the door, also having by itself the possibility of longitudinal adjustment. Therefore, we give origin to a system applicable to any door and with the security level intended for the door to be installed and therefore utilizing the same elements and requiring neither loose pieces nor complicated operations for their installation, as the only operation to carry out is that of driving screws.

It is clearly proven that we give life to a new concept in these safety systems of multiple closing, which can be fitted even by unskilled labourers, who at having only to carry out the driving of screws have not much relevance with final finishing in what refers to safety or to aesthetic.

For a better understanding of the invention nature, we show in the attach drawings (as an example merely illustrative, not limitative) a preferred form of industrial realization, to which we refer in our description about the said drawings.

Figures 7, 8, 9:
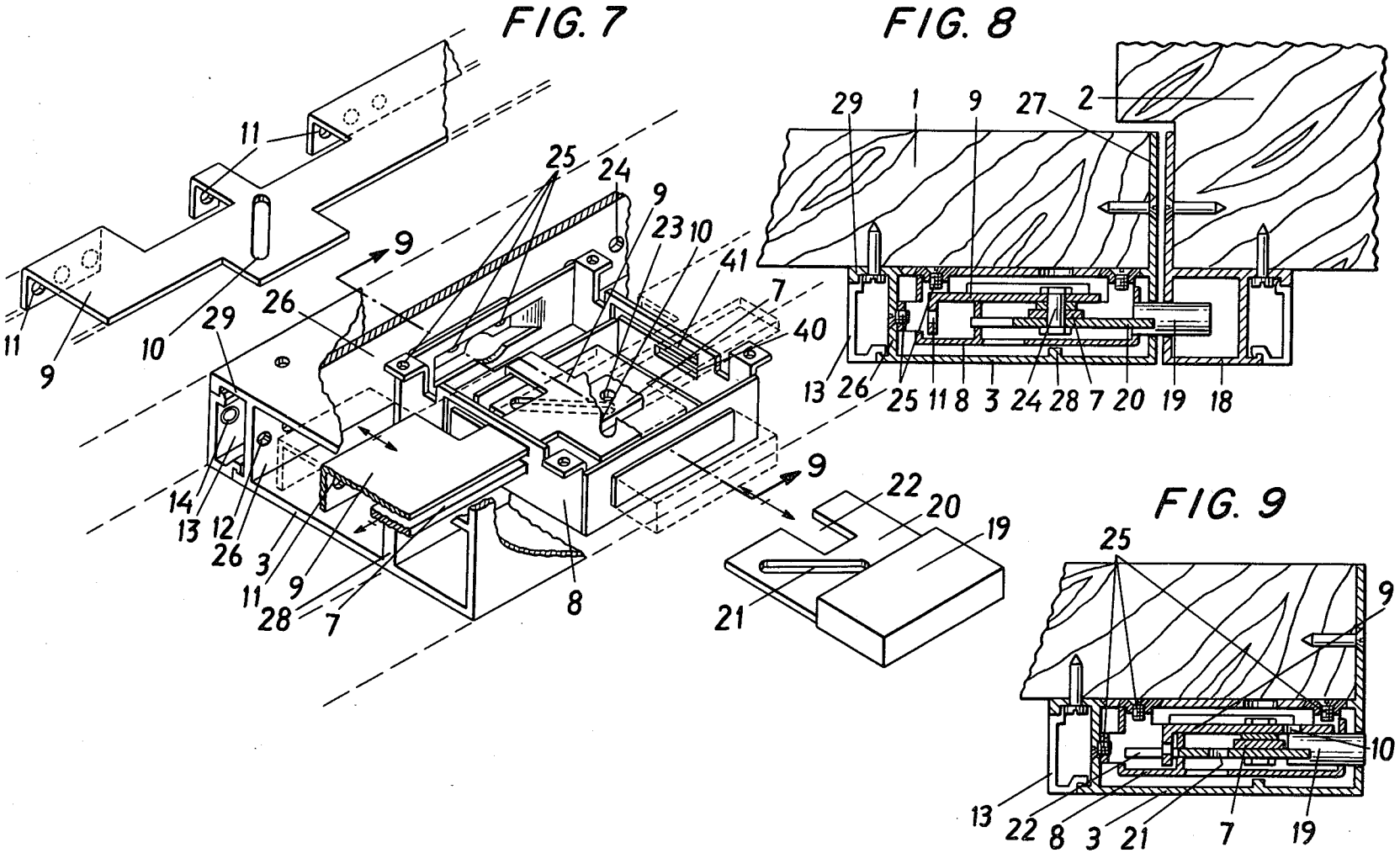
FIG. 7 is a view in arbitrarily cross-split perspective of the holder zone concurring with a bolt case, this view has been made from the inner part of holder which in use position remains backed to the door.

FIGS. 8 and 9 correspond to the cut given to FIG. 7 by the section indication 30—30, there appear the close(FIG. 8) and open (FIG. 9) positions, being the latter one where is located the device of FIG. 7.

Figures 10, 11, 12, 13, 14, 15, 16:
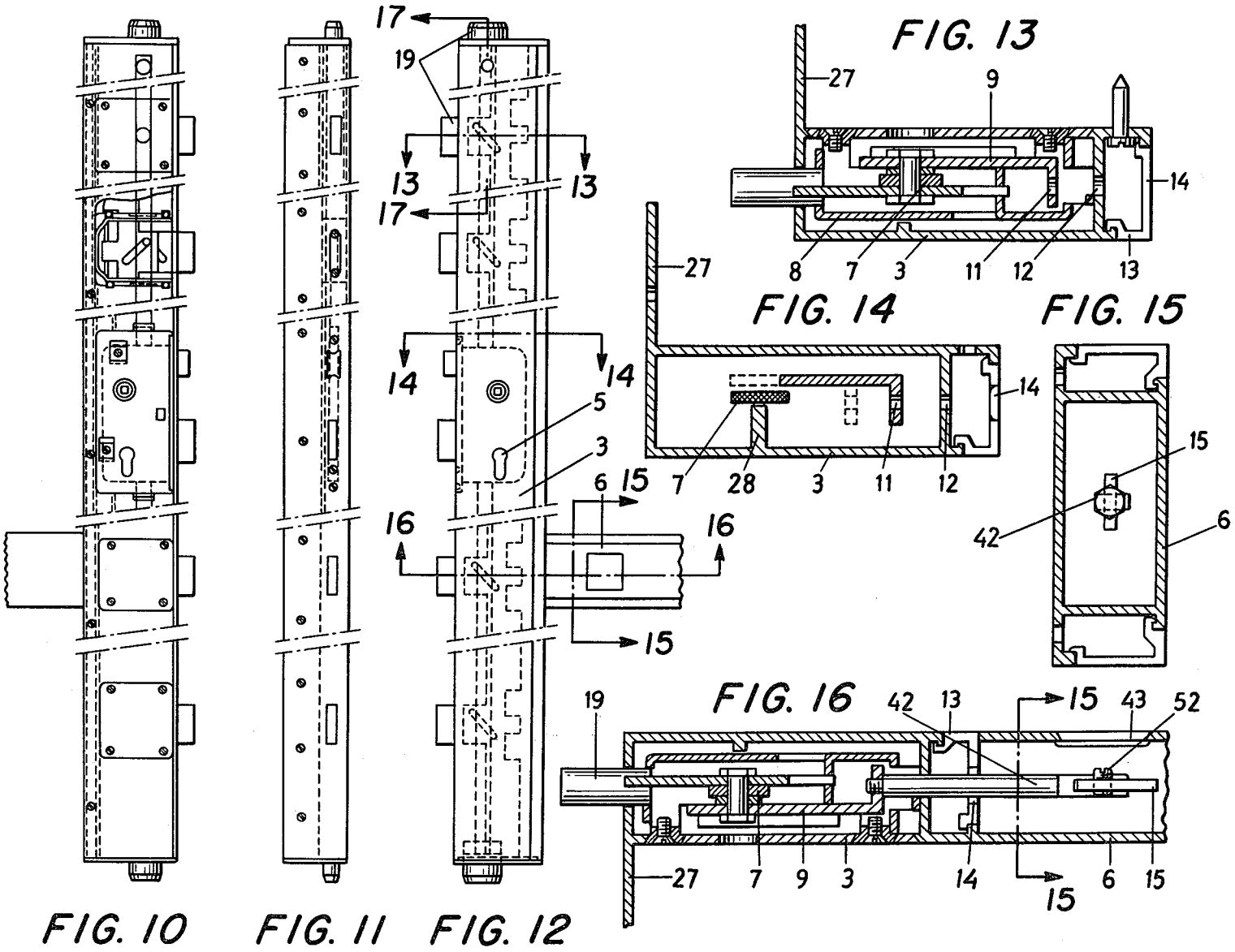

FIGS. 10, 11 and 12 are standarized views corresponding to the main holder as per our invention, in contrary projection.

FIG. 13 is section 31—31 indicated in FIG. 12.

FIG. 14 is section 32—32 indicated in FIG. 12.

FIG. 15 is section 35—35 indicated in FIGS. 12 and 16.

FIG. 16 is section 33—33 indicated in FIG. 12.

Figure 18:
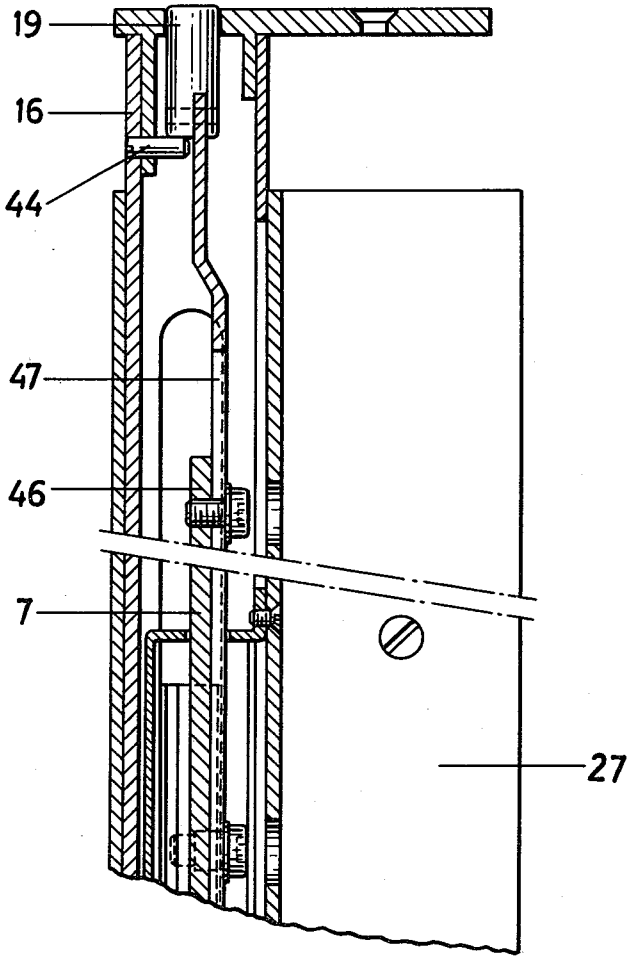
Figure 17:
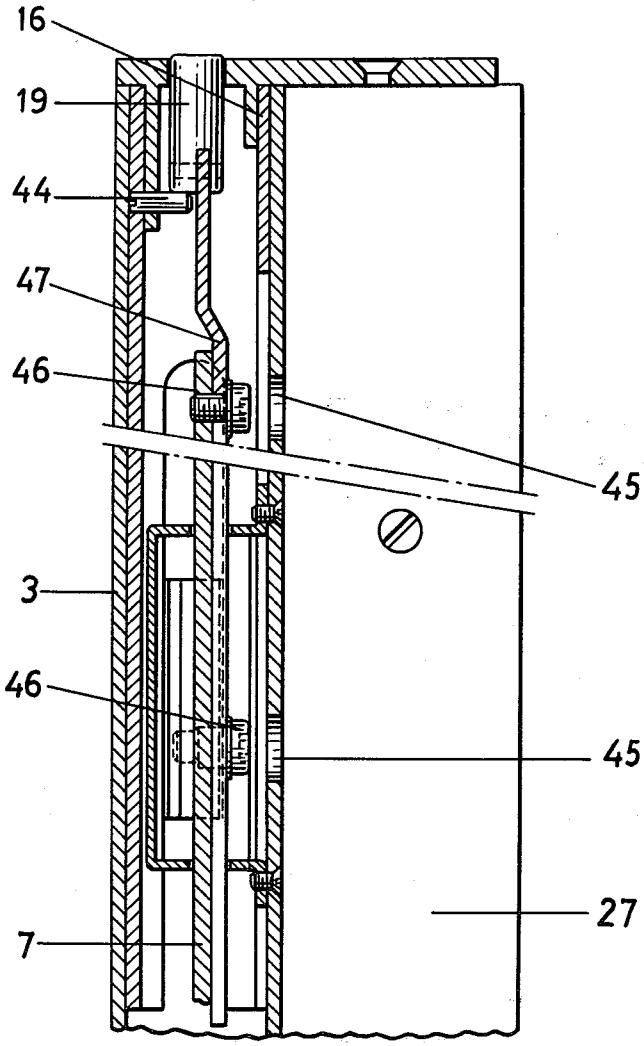

FIGS. 17 and 18 correspond to section indicated 34—34 of FIG. 12, duly enlarged and with the elements in the first position case without being extended and in the second partially extended.

Figures 19, 20, 21, 22, 23, 24, 25, 26, 27, 28, 29:
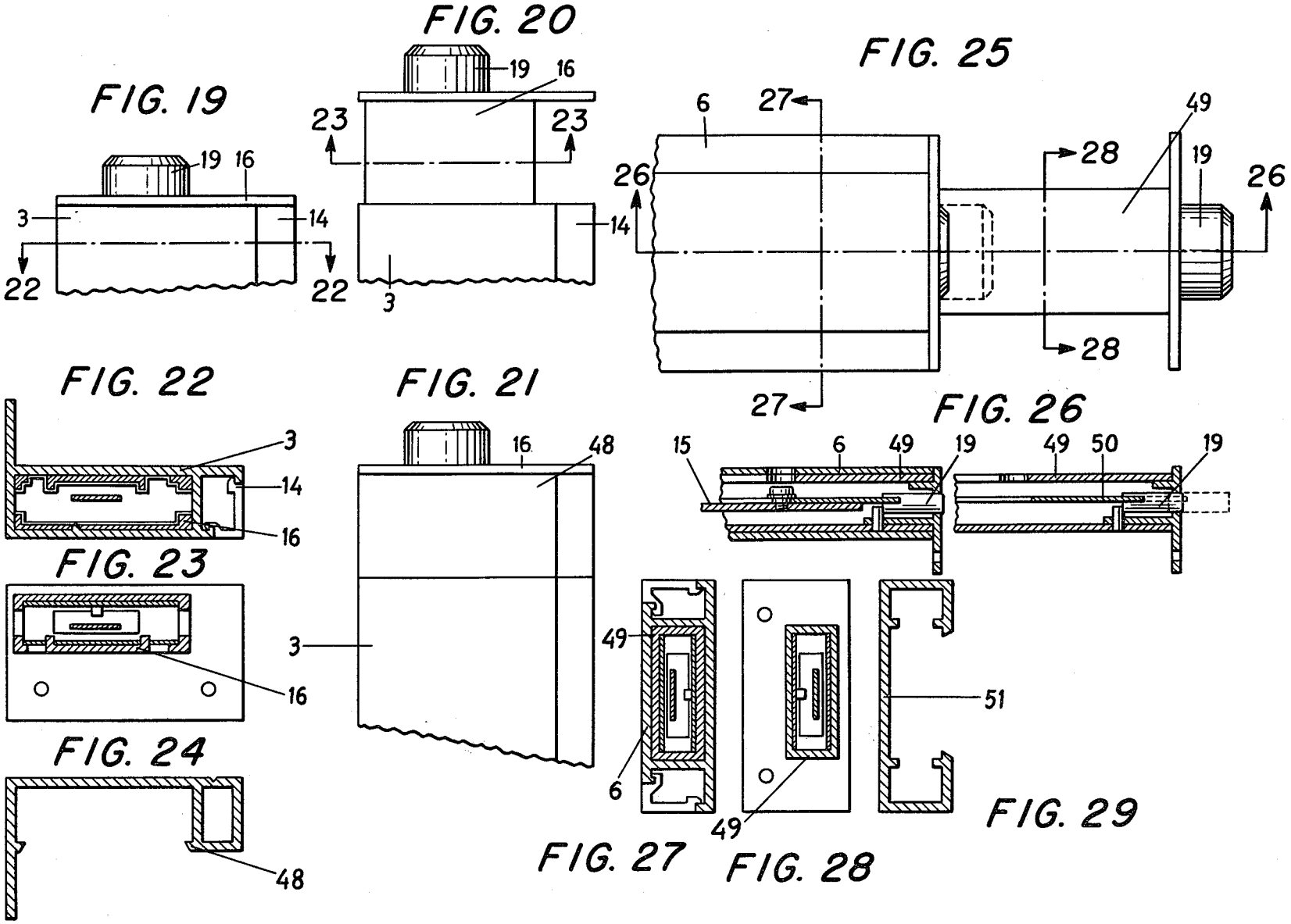

FIGS. 19 and 20 correspond with the prior figures and also show the point of main holder with their elements without being extended and partially extended.

FIG. 21 is similar to FIG. 20 but having covered the extension with an embellishment piece.

FIG. 22 corresponds to section 36—36 of FIG. 19.

FIG. 23 corresponds to section 37—37 indicated in FIG. 20.

FIG. 24 is a view of the section in profile of end embellishment.

FIG. 25 is a view in escalation of the extensible strongback.

FIG. 26 is section 40—40 indicated in FIG. 25.

FIG. 27 is section 38—38 indicated in FIG. 25.

FIG. 28 is section 28—28 indicated in FIG. 25.

FIG. 29 is a section view of element 6 as shown in FIG. 25.

Figures 1, 2, 3, 4, 5, 6:
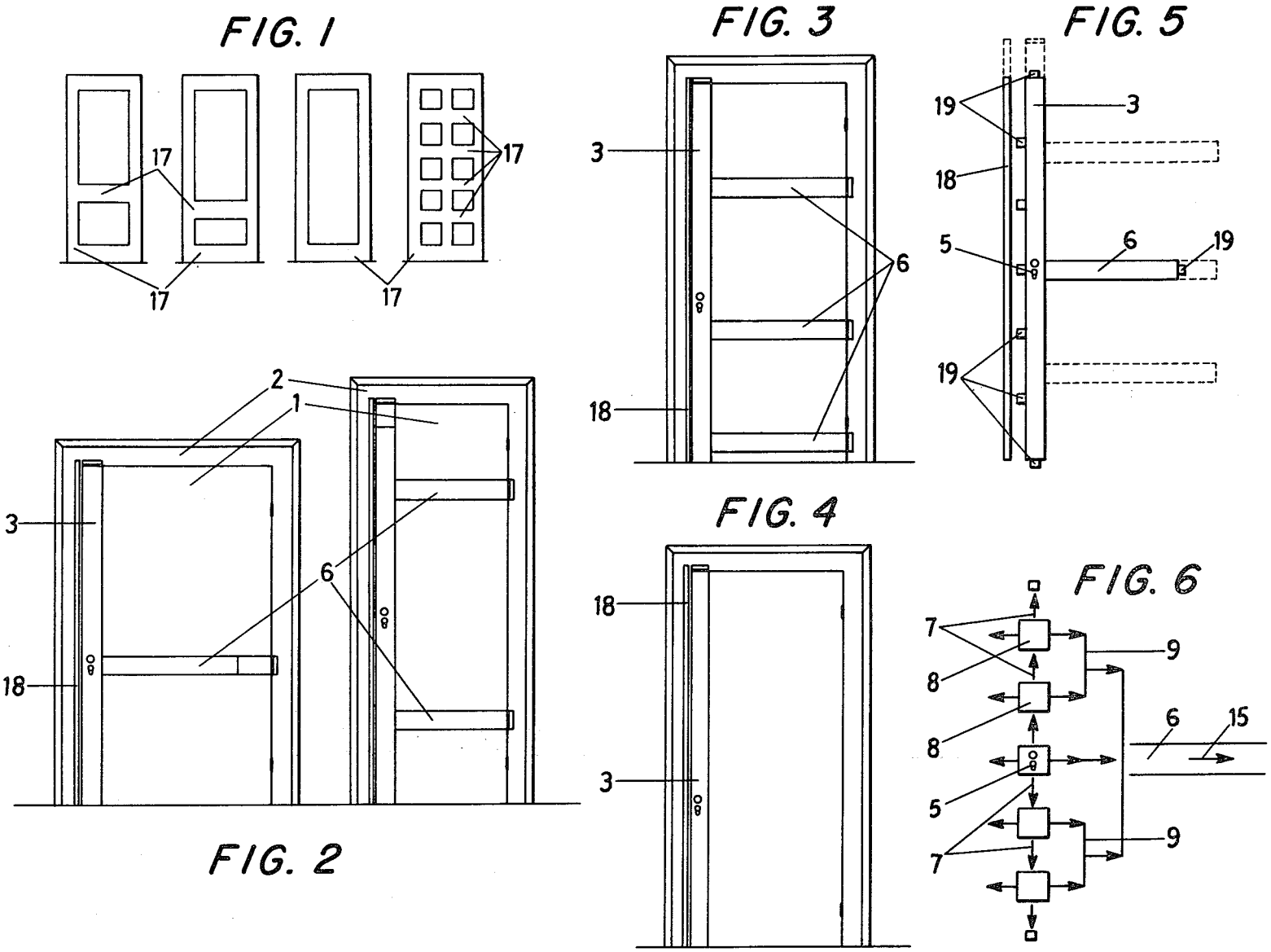
FIG. 1 shows four types of doors surface.
FIGS. 2, 3 and 4 show different types of doors with the system subject of present invention therein installed.
FIG. 5 shows in diagram the system subject of our invention.
FIG. 6 is a schematic representation in which there is indicated the transmissions of the actuations in accordance with our invention.

In FIG. 1 we see four types of doors taken as an example of the many represented in the market and we appreciate in them delimited the rib and flat zones, nothing that the arrangement of flat zones (17) existing in the door surface occupy quite-different situations between themselves and therefore at that time of coupling any system of those known up to now there will exist great difficulties above all at the time of the installation of horizontal rails or strongbacks which requires cutting of the prominent surfaces.

Such as it appears in FIGS. 2, 3 and 4 the horizontal and vertical dimensions of a door are not equal and there are multiple variations in its configuration; nevertheless and in agreement with the purpose of our invention we have adapted it and the same closing system unit admits different horizontal and vertical dimensions as those appearing in FIG. 2 and so allows the location of the strongbacks (6) in the quantity and disposition more opportune, due to their total absence as seen in FIG. 3; in these cases and for the simplification of the drawing we have not represented upon the surfaces of these doors the ribs zones they have, but the comparison of these figures with FIG. 1, we clearly assume the possibility of adopting our system to those places in which the door represent flat surfaces and therefore to avoid the necessity of making reliefs during the installation.

In FIG. 5 is schematically shown the aim of the invention which consists in the design of an authentic lock that covers completely the vertical dimensions of the door, therein and actuated by the small-pump of common key (5) we can push all latches (19), the latter can be housed in the multiple strike located in the door frame; the main holder (3) will have, at least, on its edges, means allowing its expansion to couple it to the vertical dimension of a door, equally it will be possible to couple along its whole length and the amount desired horizontal strongback (6) also extensible in length to be adapted to the door configuration; with this versatility in what refers to dimension and accouplement we can arrive to a simple and rapid installation and with the safety degree we wish for each case.

In FIG. 6 we are schematically shown the actuation transmissions and so we can see that from the small-pump of common key (5) there is transmitted the motion of bolts (8) by the main actuating bags (7), from these cases come also the actuation to the right-angle plate (9), along which can be fitted the horizontal strongbacks (6) in whichever position and to receive the actuation for its transmission (15) of the latch it is provided with.

FIG. 7 shows an arbitrarily sectioned perspective to appreciate there the main elements that compose the system. Therein it has been duplicated the representation of the latch or bolt (19) and the right-angle plate (9) in location positioned in regard to the main representation to appreciate with more detail its configuration, which in the assembly erection can result in confusion.

It is basic for the execution of the invention the fact that, all devices and transmissions composing it are kept inside the holder (3) which consists in an only profile with closed perimeter section that will house them so constituting a lock by itself covering the whole of the vertical dimension of the door without loose pieces; this holding profile (3) absolutely closed in its perimeter, will be fixed at the door (1) by affixing the big wing (27) and the small one (29) with which this profile would roughly fix. The wall of profile (2) represent a series of holes (12) aligned very close one to the other, and will be also in this wall (2) wherein will be anchored part of the fixings (25) by means of which the case is fixed (8) of bolts and/or latches.

The profile (3) will have the rib (28) that appears either in the correct position of the case (8) or in the adequate erection and operation of the main (7) bar as later on we shall explain.

In bolt cases (8) that are seen in FIG. 7, we appreciate that the main actuating bars (7) which come out from the common key can be longitudinally moved through the cases (8) by the ripping and guides spacings (4) that represent the said cases in their walls; at the height of inner part case, bar (7) will have hole (23) in which it is produced the pin (24) and as the said pin goes also through the diagonal groove (16) of bolt (19) and the diagonal groove (10) existing in the plate (9) and the disposition of the said diagonal groove is antagonic, when the bar (7) is longitudinally moved, at this displacement there corresponds a transversal displacement and in direction opposed to the latch (19) right-angle plate (9). In FIGS. 8 and 9 appear represented the two positions of the elements of which FIG. 9 corresponds to the elements positioned in accordance with perspective of FIG. 7 and wherein FIG. 8 corresponds to the elements in position of closed latches. For a correct accouplement of the elements allowing enough range of displacement, the glue (20) of latch (19) will present a relief (22) that allows inside it the encasement of the right-angle part of the right-angle plate (9) in such a place.

The displacement of bar (7) from small-pump of common key (5) will be performed by means already known.

The right-angle plate (9) shall cover the whole dimensions of the holding profile (3) and shall present in the wing of the "L", drillings (11) in wall (26) of profile shall equally exist other drillings (12) and also aligned with both, the embellishment profile (13) that had for finality to hide the fixing screws of the unit to the door, there will exist weakened zones of round contour (14); therefore it can be produced the adequate fitting of strongback (6) at the place you wish, as later on mentioned.

In FIGS. 13 and 16 we can easily appreciate the installation process of the strongback (6); therefore in the place chosen for its installation we shall give a blow to the embellishment weakened zone (14), so that in the said zone an orifice is made which will be respectively aligned with orifice (12) of the holding profile wall (3) and with the threaded hole (11) of the right-angle plate (9); there it will be enough that with said threaded hole (11) we affix the joint piece (42) and that leaning the strongback (6) we affix it by screw (52) that fixes the jointing piece (42) with the actuation transmission (15) that has the horizontal strongback (6), this operation can be easily executed through the window (43) that will have the profile outlining the horizontal strongback. It will be therefore possible to verify the erection of strongback (6) in whichever positions as orifices there exist along the wing of the right-angle plate (9), then practically at any position and equally it will be easy the setting of as many horizontal strongbacks as required as per the safty degree that we wish to give to the system. At any case the actuation of the latch of the strongback(s) will be simultaneous with that of the other lach of system, all of them driven by the small-pump of the common key (5).

In FIG. 14 we appreciate a section given to the holding profile (3) in a place wherein is not a bolt case, in this place we observe as the rib (28) serves as guide of the main actuation bar (7) and equally we see that also at that place it can be verified the coupling of an horizontal strongback by existing of the orifices of plate wing (11) of profile wall (12) and the weakened zone (14), all of them duly aligned.

The adjustment in length of the main holder (3) so to adapt it to any door dimension is graphically represented in FIGS. 17 and 18 wherein are indicated in the first of them the holder taking its position of minimum dimension and in the second an intermediate position in which it has suffered some extension. To execute it, the main holder (3) will have at one of its sides a profiling cover (16) which external outline is coupled to the internal one of the holding profile (3) and between them a telecopic slippage can be performed. In cover (16) there will be a hook (44) that stops against the latch (19) so that in expansion of cover (16) to draw at the main longitudinal bar (7). In the main longitudinal bar (7) shall exist accessible means from outside allowing its length variation and fixing to a determined dimension. The means represented in FIGS. 17 and 18 consist in which the main actuating bar (7) is outlined in this edge with an artificial part (47) connected by screws (46), these screws are threaded to the main bar (7) meanwhile house in a ripping groove existing in the artificial part (47); it will be enough that through the two orifices (holes) (45) we loose screws (46) to verify the extension of the lid (16) and that the transmission is extended as much as in the external extension when drawing by the hooking screw (44); once obtaining the required extension, we shall tighten the screw (46) again so to lock it in its position and lock (19) can actuate correctly.

In FIGS. 19, 20 and 21 there are seen in front detail the extension above mentioned. In FIG. 21 and to cover the step produced by the extension of the lid (16) we have came to use a staffbead embellishment profile (48) that is externally located to the line of main holder (3) and lid (16). As an explicative detail of the coupling of this staffbead embellishment we have FIGS. 22, 23 and 24 and from what there is seen one can clearly appreciate how one can verify its hooking.

The extension for the longitudinal coupling either of the strongback (6) as the multiple bolt-staple (18), it will be executed by means similar to the adjustment in extension of main holder (3) and with explicative character, in FIGS. 25, 26, 27, 28 and 29, we represent the terminal of the strongback (6) which also can be provided with an artificial cover (49) and with a staffbead embellishment profile (51), we believe that the said figures do not need any special mention.

Such as represented in the drawings and as clearly assumed, besides the multiple strikes (18) there will be unit strikes at the upper and lower part of the door to house the end locks (1) of the main bar (7) and equally in the frame corresponding to the hinges of the door shall be disposed joint strikes to house the end latches (19) of the horizontal strongbacks (6) that are installed.

With all the above mentioned, it is clearly evidenced that in accordance with our invention we have designed an authentic integral lock that covers the whole door, allowing its dimensional adjustment and the utilization of one or several horizontal strongbacks located at any position; besides it avoids loose pieces and for its installation there will be only required the driving of screws, which is superior to all systems known up to now, such as has been exposed in the example and are merely illustrative in explaining our invention.

Once thoroughly described the nature of the present invention, as well as its industrial execution, it is only necessary to add that in its whole assembly and constitutive parts it is possible to introduce exchanges in form, materials and arrangement, without going too far from the invention drawing, in whatever such alterations do not lessen the value of its fundament.

I claim:

1. A security lock system comprising a plurality of bolts operated by a common key and a corresponding multiple strike for accommodating said bolts; a main carrier including a single box section forming a lock covering the entire vertical dimension of the door; said main carrier having at at least one of the ends thereof means for adjustment in length to the vertical dimension of the door; means for common operation of the plurality of bolts; said bolts including bolts in at least one cross bar, said cross bar being adjustably locatable at any height on said door; said cross bar and said multiple strike having adjustment means therein for adjusting the lengths thereof.

2. The structure of claim 1 wherein the common locking means includes a longitudinal transmission rod and further comprising an L-shaped right angle plate; said L-shaped right angle plate being mounted in said main carrier for transverse movement with respect to said longitudinal transmission rod during operation of said bolts; a wing of said L-shaped right angle plate having perforations positionally coinciding with openings in a wall of the box section; a longitudinal decorative section having a plurality of weakened circular zones therein, said longitudinal decorative section being mounted so that said weakened circular zones are in correspondence with the openings in the box section; transmission means for actuating said cross bar; and said transmission means being mountable on said L-shaped right angle plate at a predetermined location, the access for mounting being gained by breaking through one of said weakened circular zones.

3. The structure of claim 1 wherein said means for vertical adjustment is a shaped cover, the external configuration thereof matching the internal configuration of said main carrier for telescoping movement therewith; a pin on said cover; said pin being attached to said longitudinal transmission rod wherein said rod will be drawn with said cover when said cover is extended; means in said transmission rod for extension thereof, the extension means being accessible from outside said main carrier for enabling the change of length and its setting at a particular dimension.

4. The structure of claim 3 wherein the means for varying the length of the longitudinal transmission rod comprises two plates disposed back to back; one of said plates having slots and the other being threaded for receiving a screw therein; the location of said slot and holes coinciding in position with an aperture in said carrier which permits the passage of a screwdriver therethrough.

* * * * *